US008459422B1

(12) United States Patent
Efron

(10) Patent No.: US 8,459,422 B1
(45) Date of Patent: Jun. 11, 2013

(54) LUGGAGE WITH INTEGRATED VACUUM BAGS

(76) Inventor: Chad Efron, Port St. Lucie, FL (US)

( * ) Notice: Subject to any disclaimer, the term of this patent is extended or adjusted under 35 U.S.C. 154(b) by 489 days.

(21) Appl. No.: 12/843,927

(22) Filed: Jul. 27, 2010

(51) Int. Cl.
*A45C 13/00* (2006.01)

(52) U.S. Cl.
USPC ..... 190/109; 190/903; 190/36; 190/125; 206/524.8

(58) Field of Classification Search
USPC ..... 206/524.8, 550, 543, 544, 522; 190/903, 190/36, 125, 109; 383/3, 48; 220/62.21
See application file for complete search history.

(56) References Cited

U.S. PATENT DOCUMENTS

| | | | | |
|---|---|---|---|---|
| 3,000,418 | A * | 9/1961 | Bitting | 180/53.8 |
| 4,801,213 | A | 1/1989 | Frey | |
| 5,042,663 | A * | 8/1991 | Heinrich | 206/522 |
| 5,251,731 | A | 10/1993 | Cassese | |
| 5,806,575 | A | 9/1998 | Tsay | |
| 6,065,870 | A | 5/2000 | Nunez | |
| 6,135,253 | A | 10/2000 | Weissman | |
| 6,202,849 | B1 * | 3/2001 | Graham | 206/524.8 |
| 6,499,574 | B1 | 12/2002 | Anthony | |
| 6,651,520 | B1 * | 11/2003 | Allen et al. | 73/863.81 |
| 7,475,782 | B2 * | 1/2009 | Lombardi | 206/524.8 |
| D601,342 | S | 10/2009 | Choi | |
| 8,042,662 | B2 * | 10/2011 | Su | 190/115 |
| 8,210,353 | B2 * | 7/2012 | Epicureo | 206/524.8 |
| 8,251,192 | B1 * | 8/2012 | Milani | 190/103 |
| 2009/0145939 | A1 * | 6/2009 | Robinson | 224/231 |
| 2011/0259693 | A1 * | 10/2011 | Nascarella | 190/18 A |

* cited by examiner

*Primary Examiner* — Tri Mai
(74) *Attorney, Agent, or Firm* — Kyle Fletcher

(57) ABSTRACT

The luggage with integrated vacuum bags includes a standard piece of luggage that includes at least one vacuum bag within said piece of luggage. The vacuum bags are vacuumed via a vacuuming means integrated on a side of said luggage, which engages a male valve located on an exterior surface of said luggage and of which engages a female valve located on a vacuum bag. The vacuum bags are filled with items typically associated with luggage (garments, etc.) in anticipation of vacuuming, which increases the packing efficiency of the luggage such that more items may be packed into said luggage than when compared with luggage excluding said vacuum bags. The vacuuming means includes a hose, motor, and powering means and vacuums the vacuum bag(s) from outside of said luggage.

18 Claims, 5 Drawing Sheets

LUGGAGE WITH INTEGRATED VACUUM BAGS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of luggage, more specifically, a piece of luggage that features vacuum bags integrated therein and of which save space inside of the luggage.

B. Discussion of the Prior Art

As will be discussed immediately below, no prior art discloses a piece of luggage having an integrated vacuum bag storage system that increases packing efficiency within said piece of luggage; wherein at least one vacuum bag is located within said piece of luggage and of which is vacuumed via a vacuuming means located on a side of said luggage which engages a male valve located on an exterior of said luggage, which marries to a female valve located on a vacuum bag located within said luggage.

The Anthony Patent (U.S. Pat. No. 6,499,574) discloses a vacuum packed suitcase with sealable compartments for vacuum sealing of articles of travel, such as clothing and makeup accessories, thereby reducing the volume of the articles of travel to a minimum and thus increasing storage efficiency. However, the suitcase does not have a male valve located on the exterior of the suitcase that marries up to a female valve located within said suitcase and upon a liner that upon deflation will increase packing efficiency within the suitcase.

The Weissman et al. Patent (U.S. Pat. No. 6,135,253) discloses a suitcase that has an airtight liner that can be compressed by a vacuum pump to reduce the volume of clothes to fit within the suitcase which also has a valve to hold and release the vacuum. Again, the suitcase does not teach a male valve located on the suitcase's exterior that marries up with a female valve situated upon a liner located in the exterior of said suitcase, which will deflate said liner apart of a vacuum bag in order to increase packing efficiency within said suitcase.

The Nunez Patent (U.S. Pat. No. 6,065,870) discloses an inflatable luggage insert. However, the insert is not designed to increase packing efficiency or include valves located on a liner and exterior surface that enable a vacuum bag to be deflated therein.

The Casese et al. Patent (U.S. Pat. No. 5,251,731) discloses a collapsible suitcase that provides a structure which, when in a compressed condition, will need less space for storage when not in use. However, the suitcase collapses in overall size to enable storage efficiency of the suitcase and not packing efficiency of items contained within during use.

The Choi Patent (U.S. Pat. No. Des. 601,342) illustrates an ornamental design for a luggage case, which does not depict a vacuuming means or vacuum bags contained within.

The Frey et al. Patent (U.S. Pat. No. 4,801,213) discloses an inflatable insert for luggage. However, the insert is designed to inflate in roder to protect fragile items within and not decrease the volume of content contained within in order to protect packing efficiency.

The Tsay Patent (U.S. Pat. No. 5,806,575) discloses a vacuum extractor for a luggage article. However, the extractor does not feature a vacuuming compartment located on a separate exterior portion of said luggage in which a vacuum hose can be connected to a male valve on an exterior surface that marries up with a female valve in order to deflate a liner in connection with a vacuum bag in order to increase packing efficiency within said suitcase.

While the above-described devices fulfill their respective and particular objects and requirements, they do not describe a piece of luggage having an integrated vacuum bag storage system that increases packing efficiency within said piece of luggage; wherein at least one vacuum bag is located within said piece of luggage and of which is vacuumed via a vacuuming means located on a side of said luggage which engages a male valve located on an exterior of said luggage, which marries to a female valve located on a vacuum bag located within said luggage. In this regard, the luggage with integrated vacuum bags departs from the conventional concepts and designs of the prior art.

SUMMARY OF THE INVENTION

The luggage with integrated vacuum bags includes a standard piece of luggage that includes at least one vacuum bag within said piece of luggage. The vacuum bags are vacuumed via a vacuuming means integrated on a side of said luggage, which engages a male valve located on an exterior surface of said luggage and of which engages a female valve located on a vacuum bag. The vacuum bags are filled with items typically associated with luggage (garments, etc.) in anticipation of vacuuming, which increases the packing efficiency of the luggage such that more items may be packed into said luggage than when compared with luggage excluding said vacuum bags. The vacuuming means includes a hose, motor, and powering means and vacuums the vacuum bag(s) from outside of said luggage.

An object of the invention is to provide a piece of luggage with at least one vacuum bag integrated into the design of the luggage such that the vacuum bag is vacuumed from an exterior of said luggage, and with the intent of improving the packing efficiency of the luggage.

A further object of the invention is to provide vacuuming means responsible for vacuuming said vacuum bags, which is integrated into the piece of luggage such that an external vacuuming system is not required in order to operate the vacuum bags.

A further object of the invention is to include vacuuming means that are portably powered so as to enable operation of the vacuuming means in any location.

A further object of the invention is to provide a piece of luggage comprising a duffel bag, suitcase, garment bag, or other type of luggage with vacuum bags integrated therein and of which are vacuumed via vacuuming means integrated into a side of said piece of luggage.

These together with additional objects, features and advantages of the luggage with integrated vacuum bags will be readily apparent to those of ordinary skill in the art upon reading the following detailed description of presently preferred, but nonetheless illustrative, embodiments of the luggage with integrated vacuum bags when taken in conjunction with the accompanying drawings.

In this respect, before explaining the current embodiments of the luggage with integrated vacuum bags in detail, it is to be understood that the luggage with integrated vacuum bags is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the luggage with integrated vacuum bags.

It is therefore important that the claims be regarded as including such equivalent construction insofar as they do not depart from the spirit and scope of the luggage with integrated vacuum bags. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
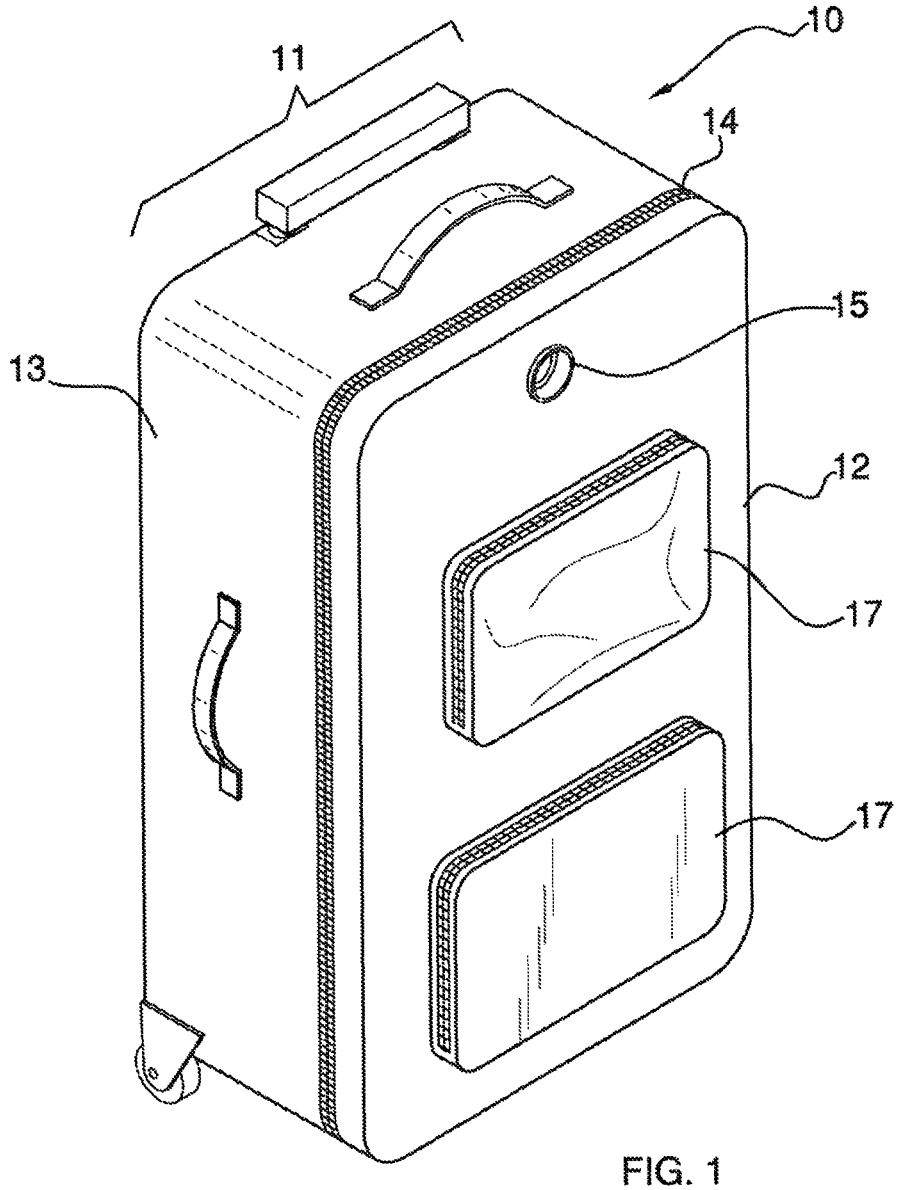
FIG. 1 illustrates an isometric view of the luggage with integrated vacuum bags by itself and with the luggage in a closed position and concealing the vacuum bags contained within.
Figure 2:
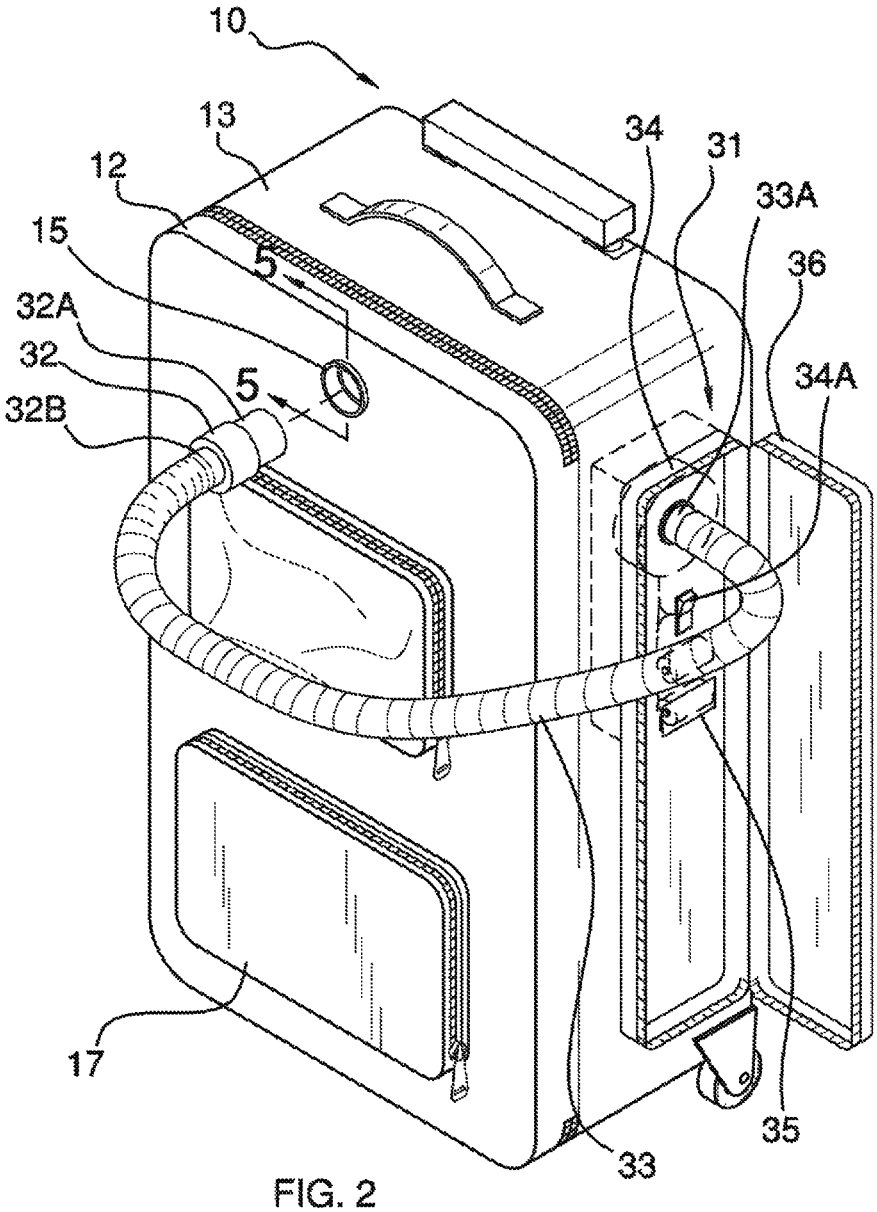
FIG. 2 illustrates an isometric view of the luggage with integrated vacuum bags wherein the vacuum hose is extended from the hose compartment to attach to the air valve.

Detailed reference will now be made to the preferred embodiment of the present invention, examples of which are illustrated in FIGS. 1-5. A luggage with integrated vacuum bags 10 (hereinafter invention) includes a piece of luggage 11 of typical construction involving a top 12 and base 13 that are fastened to a closed state as depicted in FIG. 1 via fastening means 14. The luggage 11 may feature a plurality of pockets 17.

At least one vacuum bag 21 is located within the base 13, and is comprised of a vacuum bag top 22 that has sides 23 that form an air-tight seal via a sealing means 24. The sealing means 24 comprises a slidable zip-lock that is well known in the art of freezer bags, such as Zip-Lock, and like brands.

Located on the vacuum bag top 22 is a female valve 25. A corresponding male valve 15 is located on the top 12 of the luggage 11 and marries up with the female valve 25 when the vacuum bag top 22 is sealed to the sides 23 and when the top 12 is secured to the base 13 of the luggage 11. It shall be hereby noted that the term marries or marry is used to imply where two parts connect to one another and form an air-tight seal there between for use in a vacuuming capacity.

A vacuuming means 31 is integrated into a side of the luggage 11 and works with the male valve 15 to vacuum out air located within the vacuum bag 21. The vacuuming means 31 can marry with either the male valve 15 and the female valve 25. The vacuuming means 31 is responsible for vacuuming air from within the vacuum bag 21 in order to increase the packing efficiency of the invention 10.

The female valve 25 includes a shoulder 25A that marries with a shoulder 15A located on the male valve 15. The shoulder 25A can also marry up with a vacuum hose connector piece 32 that is located on an end of a vacuum hose 33. The vacuum hose connector piece 32 includes a shoulder 32A that can marry up with either the shoulder 15A of the male valve 15 or the shoulder 25A of the female shoulder 25 in order to conduct vacuuming services onto the vacuum bag 21 located within the luggage 11.

Figure 5:
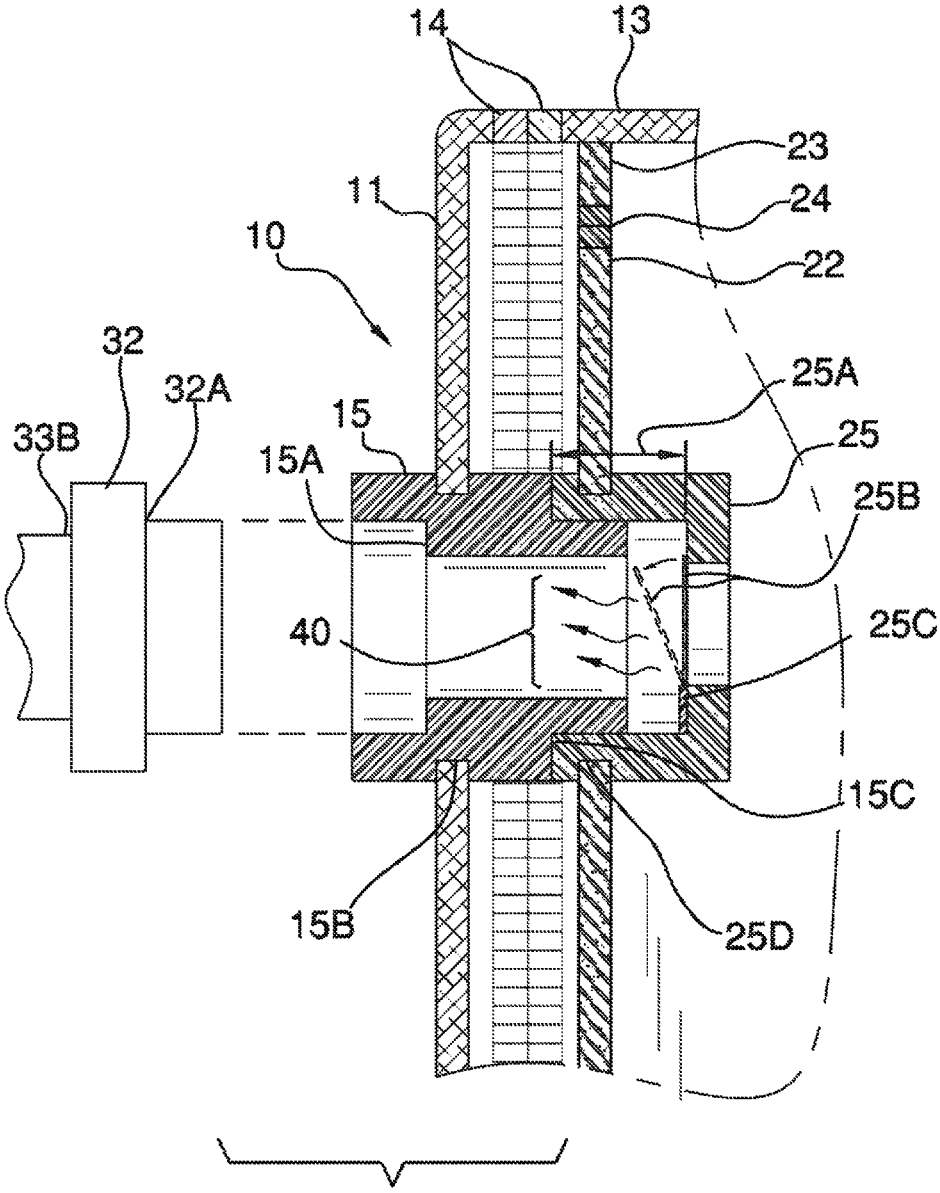
FIG. 5 illustrates a cross-sectional view of the luggage with integrated vacuum bags along line 5-5 in FIG. 2 and detailing the inter-connection of the male air valve located on the exterior with the female air valve located on the inner liner.

The female valve 25 includes a valve piece 25B that is located on the female valve 25 such that the valve piece 25B rotates away from the surface of the female valve 25 when a vacuum is formed thereon in order to extract air from within the vacuum bag 21 (see FIG. 5). A small portion of the valve piece 25B is connected to said surface of said valve piece 25 such that the remaining portion of the valve piece 25B is free to rotate away from said surface. The valve piece 25B is made of a flexible material that forms a biasing force that returns the valve piece 25B to a normally closed state touches the remaining portion of the valve piece 25B against the surface of the female valve 25.

Referring to FIG. 5, the male valve 15 is essentially a cylindrical piece having the collar 15A for receiving the vacuum hose connector piece 32. The male valve 15 includes a groove 15B that is located in the male valve 15 and secures the male valve 15 to the top 12 of the luggage 11. A second shoulder 15C located on the male valve 15 is responsible for marrying the male valve 15 to the female valve 25.

The female valve 25 features the collar 25A forming a depth sufficient to marry the female valve 25 to the male valve 15, and also not obstruct the movement of the valve piece 25B therein.

The female valve 25 includes a groove 25D that secures the female valve 25 to the top 22 of the vacuum bag 21.

The vacuuming means 31 includes the vacuum hose 33 that attaches along a first end 33A to a motor 34; whereas the vacuum hose connector piece 32 connects to a second end 33B of the vacuum hose 33. The motor 34 is powered via a powering means 35 comprising at least one rechargeable battery. A switch 34A controls operation of the motor 34 from within the pouch 36. The vacuuming means 31 includes a pouch 36 integrated into a side of the luggage 11 such that the pouch can be opened to access the vacuum hose 33 and the vacuum hose connector piece 32. Both the vacuum hose 33 and the vacuum hose connector piece 32 extend out from the pouch 36 to marry with either the male valve 15 and the female valve 25 in order to vacuum out and remove air 40 from inside of the vacuum bag 21.

Figure 3:
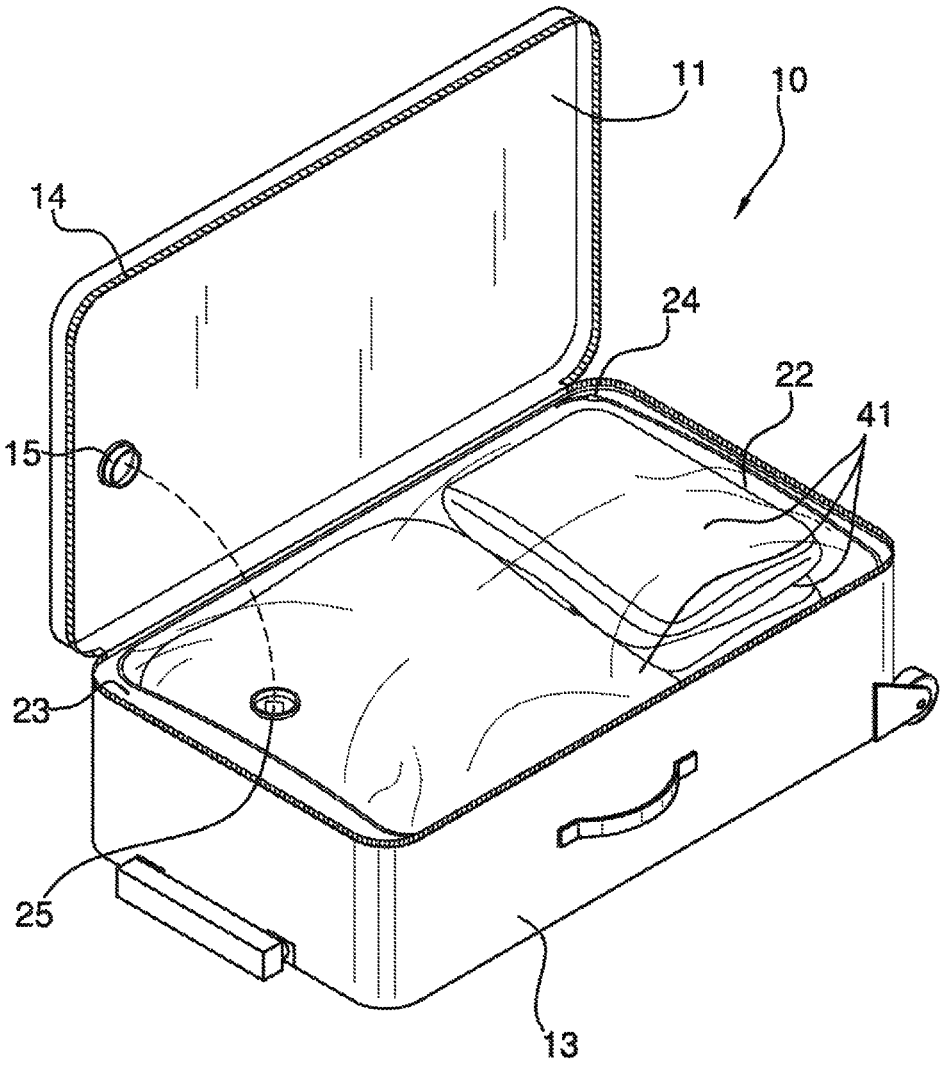
FIG. 3 illustrates an isometric view of the luggage with integrated vacuum bags wherein the luggage is laid flat with the front unzipped and folded vertically with respect to the luggage, and detailing the male valve located on the exterior and adjoining female air valve located on an inner liner.
Figure 4:
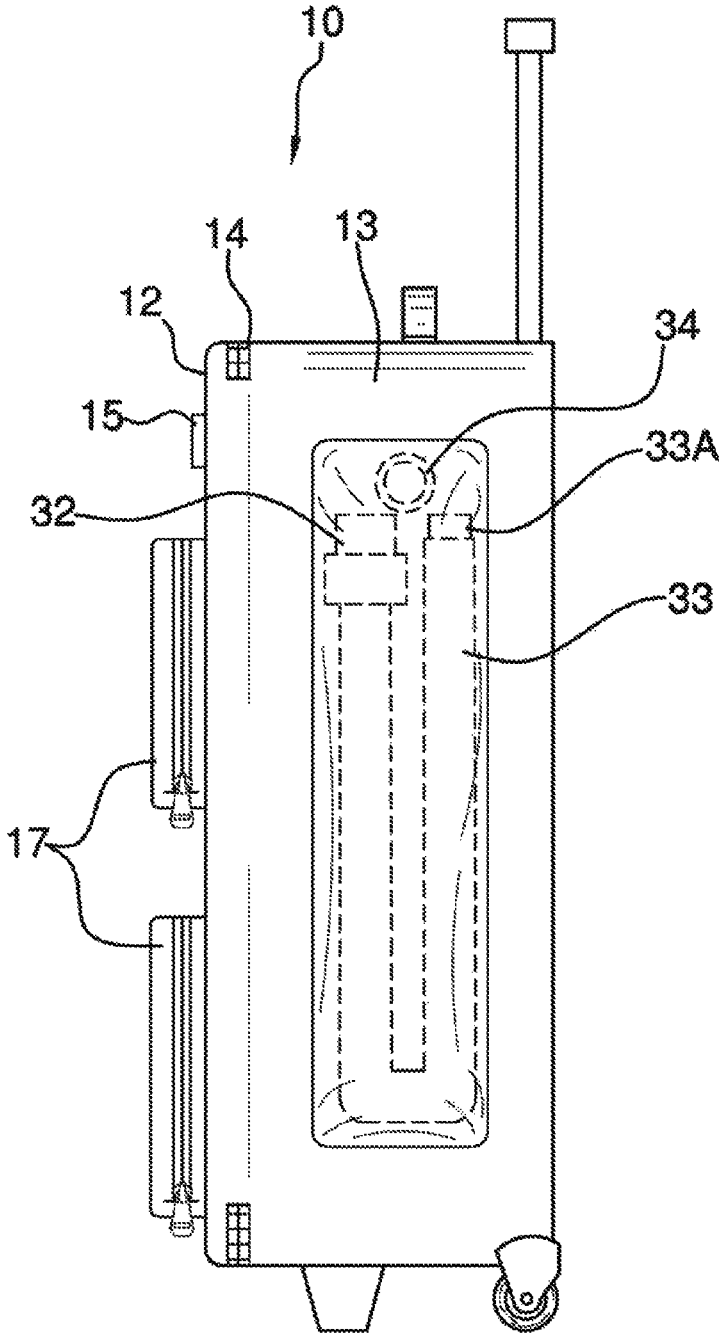
FIG. 4 illustrates a side view of the luggage with integrated vacuum bags wherein the vacuuming means including the vacuum hose and related componentry located within are depicted in dashed lines.

The vacuum bag 21 forms an enclosure formed by the interior surface of the base 13, the sides 23, and the top 22 to encompass items such as garments 41 (see FIG. 3).

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A luggage with integrated vacuum bags, further comprising:

a piece of luggage that includes a zippered top that opens to reveal a vacuum bag contained therein;

wherein said vacuum bag includes a female valve located on said vacuum bag that marries to a male valve located on said top such that a vacuuming means can vacuum air from within said vacuum bag when concealed inside of the luggage;

wherein vacuuming means are integrated into a side of said luggage.

2. The luggage as described in claim 1 wherein the vacuuming means further comprises a vacuum hose and vacuum hose connector piece that extend from a motor, which is powered via a powering means.

3. The luggage as described in claim 2 wherein the vacuuming means are included within a pouch located on a side of the luggage.

4. The luggage as described in claim 3 wherein the vacuum hose and the vacuum hose connector piece extend from the pouch in order to vacuum said vacuum bag.

5. The luggage as described in claim 1 wherein the male valve and female valve each feature a shoulder that enables the male valve to marry with the female valve; and wherein the vacuum hose connector piece can marry with either the male valve or the female valve.

6. The luggage as described in claim 1 wherein the female valve includes a valve piece that is located on the female valve such that the valve piece rotates away from a surface of the female valve when a vacuum is formed thereon in order to extract air from within the vacuum bag.

7. The luggage as described in claim 6 wherein a small portion of the valve piece is connected to said surface of said valve piece such that the remaining portion of the valve piece is free to rotate away from said surface.

8. The luggage as described in claim 6 wherein the female valve includes a groove that secures the female valve to the top of the vacuum bag.

9. The luggage as described in claim 1 wherein the vacuum bag is composed of sides, a top, and an interior surface of the base.

10. The luggage as described in claim 9 wherein a sealing means is situated between and connects the top to the sides of the vacuum bag in order to form an air-tight bag for vacuuming.

11. A luggage with integrated vacuum bags, further comprising:

a piece of luggage that includes a zippered top that opens to reveal a vacuum bag contained therein;

wherein said vacuum bag includes a female valve located on said vacuum bag that marries to a male valve located on said top such that a vacuuming means can vacuum air from within said vacuum bag when concealed inside of the luggage;

wherein vacuuming means are integrated into a side of said luggage and further comprise a vacuum hose and vacuum hose connector piece that extend from a motor, which is powered via a powering means; wherein a pouch located on a side of the luggage stores the vacuuming means therein when not in use.

12. The luggage as described in claim 11 wherein the vacuum hose and the vacuum hose connector piece extend from the pouch in order to vacuum said vacuum bag.

13. The luggage as described in claim 11 wherein the male valve and female valve each feature a shoulder that enables the male valve to marry with the female valve; and wherein the vacuum hose connector piece can marry with either the male valve or the female valve.

14. The luggage as described in claim 11 wherein the female valve includes a valve piece that is located on the female valve such that the valve piece rotates away from a surface of the female valve when a vacuum is formed thereon in order to extract air from within the vacuum bag.

15. The luggage as described in claim 14 wherein a small portion of the valve piece is connected to said surface of said valve piece such that the remaining portion of the valve piece is free to rotate away from said surface.

16. The luggage as described in claim 11 wherein the female valve includes a groove that secures the female valve to the top of the vacuum bag.

17. The luggage as described in claim 11 wherein the vacuum bag is composed of sides, a top, and an interior surface of the base.

18. The luggage as described in claim 17 wherein a sealing means is situated between and connects the top to the sides of the vacuum bag in order to form an air-tight bag for vacuuming.

* * * * *